US006935127B2

(12) United States Patent
Jeong et al.

(10) Patent No.: US 6,935,127 B2
(45) Date of Patent: Aug. 30, 2005

(54) REFRIGERATOR

(75) Inventors: In-Chang Jeong, Kwangju (KR); Hak-Gyun Bae, Andong (KR); Myung-Wouk Kim, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/397,269

(22) Filed: Mar. 27, 2003

(65) Prior Publication Data

US 2004/0040341 A1 Mar. 4, 2004

(30) Foreign Application Priority Data

Aug. 31, 2002 (KR) ..... 10-2002-52254

(51) Int. Cl.[7] ..... F25B 41/00
(52) U.S. Cl. ..... 62/198; 62/441; 62/526
(58) Field of Search ..... 62/198, 199, 441, 62/524, 525, 526, 52.4

(56) References Cited

U.S. PATENT DOCUMENTS 2,692,482 A * 10/1954 Shoemaker ..... 62/152
2,712,732 A * 7/1955 McGrew ..... 62/164
3,208,235 A * 9/1965 Scott ..... 62/227
4,383,421 A * 5/1983 Quesnoit ..... 62/333
4,439,998 A 4/1984 Horvay et al.
5,228,308 A * 7/1993 Day et al. ..... 62/198
5,630,323 A * 5/1997 Niijima et al. ..... 62/158
5,896,753 A * 4/1999 Kwak et al. ..... 62/441
6,058,723 A * 5/2000 Kusunoki et al. ..... 62/156
6,079,216 A * 6/2000 de Marsillac Plunkett et al. ..... 62/56
6,266,968 B1 * 7/2001 Redlich ..... 62/204
6,460,357 B1 * 10/2002 Doi et al. ..... 62/199
6,497,113 B1 * 12/2002 Yamada et al. ..... 62/441
6,591,619 B2 * 7/2003 Kaneko et al. ..... 62/117

FOREIGN PATENT DOCUMENTS

EP 0477475 A2 * 4/1992
JP 02001099556 A * 4/2001
JP 02002181397 A * 6/2002

* cited by examiner

*Primary Examiner*—William E. Tapolcai
*Assistant Examiner*—Mohammad M. Ali
(74) *Attorney, Agent, or Firm*—Staas & Halsey LLP.

(57) ABSTRACT

A refrigerator which performs various refrigeration cycles by variously changing refrigerant paths, thus accomplishing refrigerant evaporating temperatures suitable for a refrigerator compartment evaporator and a freezer compartment evaporator, respectively, and which cools a selected one of a refrigerator compartment and a freezer compartment as desired to enhance a cooling efficiency and increasing a cooling speed of the refrigerator.

28 Claims, 5 Drawing Sheets

REFRIGERATOR

CROSS-REFERENCE TO RELATED APPLICATION

This application claims the benefit of Korean Application No. 2002-52254, filed Aug. 31, 2002, in the Korean Intellectual Property Office, the disclosure of which is incorporated herein by reference.

BACKGROUND OF THE INVENTION

1. Field of the Invention

The present invention relates, in general, to refrigerators and, more particularly, to a refrigerator which is provided with a freezer compartment and a refrigerator compartment.

2. Description of the Related Art

Generally, a refrigerator is designed such that a cabinet thereof is partitioned into a freezer compartment and a refrigerator compartment by a partition wall. A freezer door and a storage door are hinged to the cabinet so as to open or to dose the freezer compartment and the refrigerator compartment, respectively. An evaporator and a fan are mounted to an inside surface of the freezer compartment to produce cool air and supply the cool air into the freezer compartment. The refrigerator compartment is provided on an inside surface with an evaporator and a fan to produce cool air and supply the cool air into the refrigerator compartment. Thus, cool air is independently supplied into the freezer compartment and the refrigerator compartment, respectively. Such a system is referred to as an independent cooling system.

FIG. 1 is a view showing a closed refrigeration circuit for conventional refrigerators. As shown in FIG. 1, the dosed refrigeration circuit of a conventional refrigerator includes a compressor 101, a condenser 102, a capillary tube 104, a refrigerator compartment evaporator 105 and a freezer compartment evaporator 107 which are connected to each other by refrigerant pipes to perform a refrigeration cycle. In this case, the capillary tube 104 serves as an expansion unit. The dosed refrigeration circuit of the conventional refrigerator also includes a first motor 103*a* driving a condenser fan 103, a second motor 106*a* driving a refrigerator compartment fan 106, and a third motor 108*a* driving a freezer compartment fan 108.

In the conventional refrigerator, the freezer compartment is used to store frozen food. A known optimum temperature range of the freezer compartment is from −18° C. to −20° C. Further, the refrigerator compartment is used to store non-frozen food for a lengthy period of time to maintain a freshness of the non-frozen food. A known optimum temperature range of the refrigerator compartment is from −1° C. to 6° C.

Thus, the optimum temperature range of the refrigerator compartment is different from the optimum temperature range of the freezer compartment, but, in the conventional refrigerator, a refrigerant evaporating temperature at the refrigerator compartment evaporator 105 is equal to a refrigerant evaporating temperature of the freezer compartment evaporator 107. Thus, a temperature of the refrigerator compartment may be excessively and undesirably low. When the temperature of the refrigerator compartment is excessively low as such, an operating time of the refrigerator compartment fan 106 is appropriately controlled to prevent the refrigerator compartment from being super cooled. Since a pressure of the refrigerant in the capillary tube 104 is reduced according to the refrigerant evaporating temperature demanded by the freezer compartment evaporator 107, the above-mentioned problem arises. That is, when an extent of a pressure reduction of the refrigerant is determined based on the refrigerant evaporating temperature demanded by the freezer compartment evaporator 107, the refrigerant in the refrigerator compartment evaporator 107 evaporates under an excessively low temperature, and the temperature of the refrigerator compartment may fall below the optimum temperature for the refrigerator compartment. In this case, frost is formed on surfaces of the refrigerator compartment evaporator 107, thus undesirably hindering the refrigerator compartment from maintaining a high percentage of humidity. Furthermore, an evaporating efficiency of the refrigerator compartment evaporator 107 becomes low, thus resulting in a low cooling efficiency of the refrigerator. Since the refrigerant must be compressed in the compressor 101 in consideration of the refrigerant evaporating temperature demanded for the freezer compartment evaporator 107, a load imposed on the compressor 101 is increased, so an energy efficiency ratio of the refrigerator is low.

SUMMARY OF THE INVENTION

Accordingly, it is an aspect of the present invention to provide a refrigerator, which performs various refrigeration cycles by variously changing refrigerant paths thereof, thus accomplishing refrigerant evaporating temperatures suitable for a refrigerator compartment evaporator and a freezer compartment evaporator, respectively, and which cools a selected one of a refrigerator compartment and a freezer compartment as desired, therefore enhancing a cooling efficiency and increasing a cooling speed.

Additional aspects and/or advantages of the invention will be set forth in part in the description which follows and, in part, will be obvious from the description, or may be learned by practice of the invention.

Accordingly, a refrigerator comprises a compressor, a condenser, a first evaporator, and a second evaporator which are connected to each other in series to perform a refrigeration cycle. The refrigerator further comprises a first expansion unit reducing a refrigerant pressure to a first pressure level such that a refrigerant flows into the first evaporator, and a second expansion unit reducing a refrigerant pressure to a second pressure level such that the refrigerant flows into the second evaporator, thus allowing the refrigerant to have different evaporating temperatures suitable for the first and second evaporators, respectively. Further, the refrigerator includes a third expansion unit provided between an outlet of the condenser and an inlet of the second evaporator, and a first path control unit controlling a first refrigerant path such that the refrigerant passing the condenser flows into one of the first expansion unit and the third expansion unit. When a pressure level of the refrigerant flowing from the condenser is reduced in the third expansion unit such that the refrigerant directly flows into the second evaporator, the refrigerant evaporates in only the second evaporator. Furthermore, the refrigerator includes a second refrigerant path provided between an outlet of the first evaporator and an inlet of the compressor, and a second path control unit controlling the second refrigerant path such that the refrigerant flowing from the first evaporator flows into one of the second expansion unit and the compressor. When the refrigerant passing the first evaporator directly flows into the compressor, the refrigerant evaporates in only the first evaporator.

BRIEF DESCRIPTION OF THE DRAWINGS

These and/or other aspects and advantages of the invention will become apparent and more readily appreciated from the following description of the preferred embodiments, taken in conjunction with the accompanying drawings of the which.

DETAILED DESCRIPTION OF THE PREFERRED EMBODIMENTS

Figure 1:
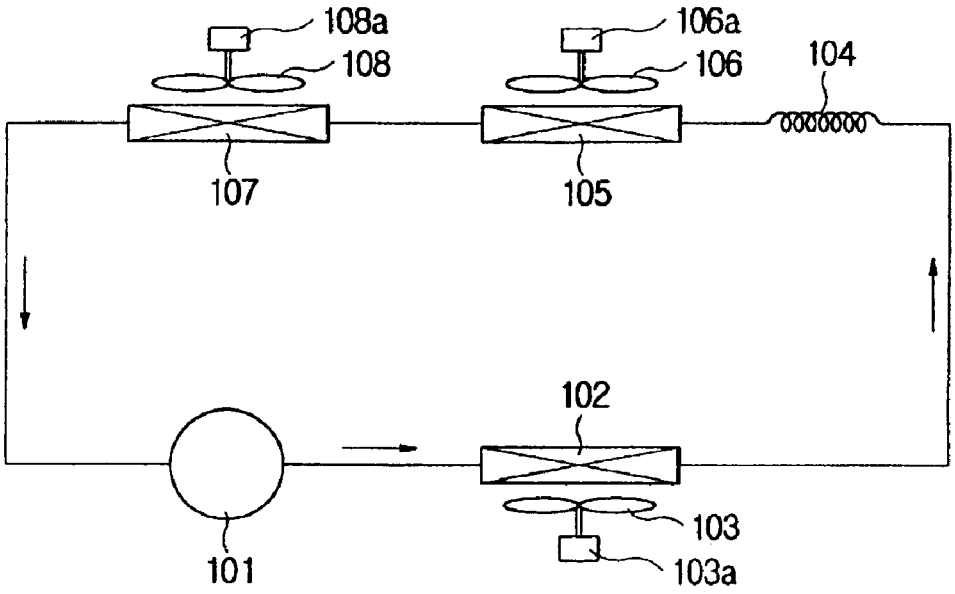
FIG. 1 (PRIOR ART)
FIG. 1 is a schematic view showing a refrigeration circuit of a conventional refrigerator.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
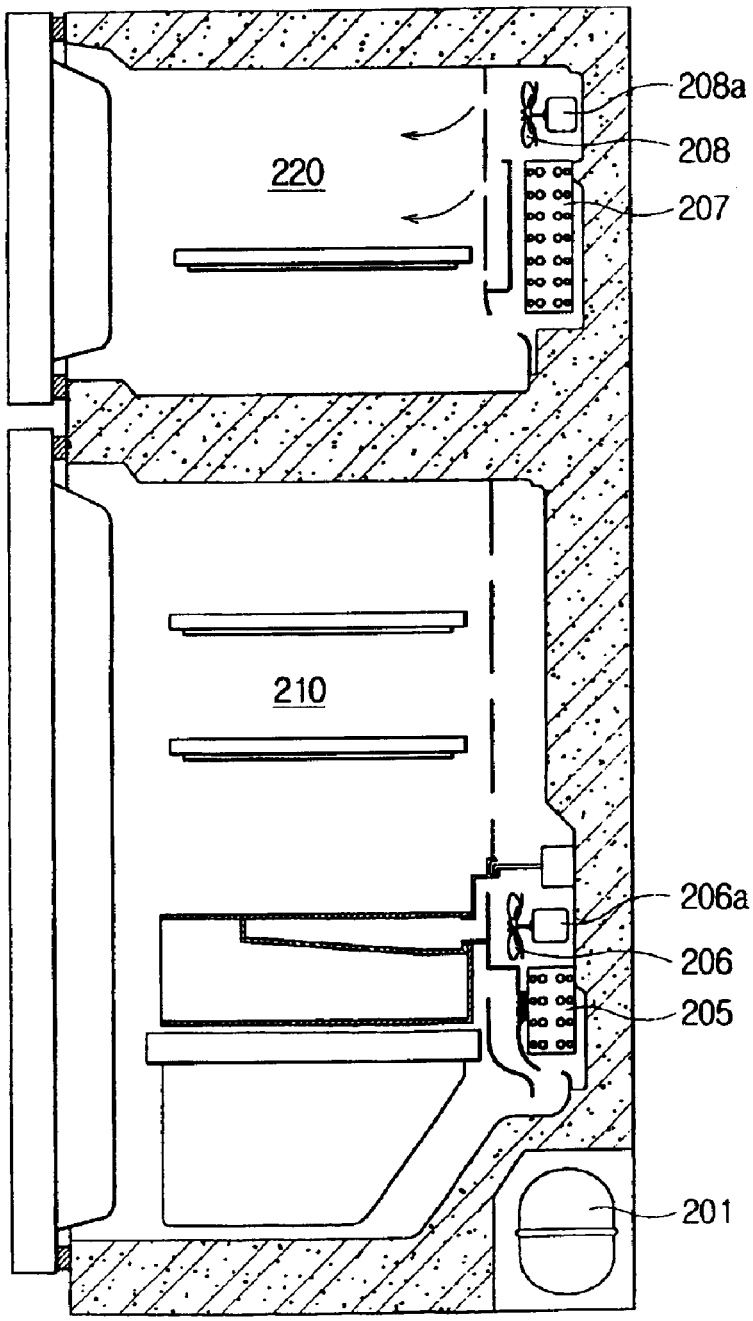
FIG. 2 is a sectional view showing a refrigerator according to first, second, and third embodiments of the present invention.
Figure 3:
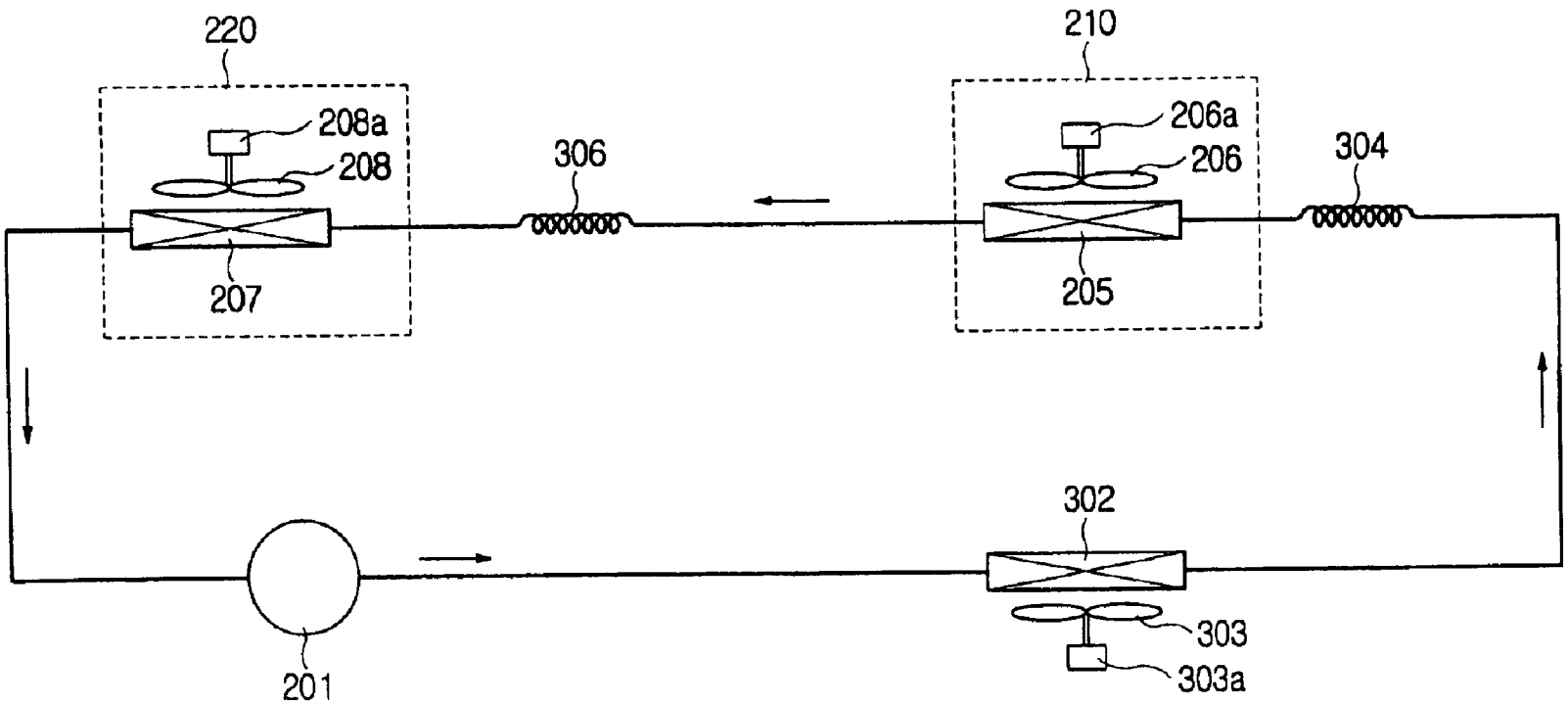
FIG. 3 is a schematic view showing a refrigeration circuit designed to accomplish an optimum refrigerant evaporating temperature for a refrigerator compartment evaporator of the refrigerator according to the first embodiment of the present invention.

FIG. 2 is a sectional view showing a refrigerator according to first, second and third embodiments of the present invention. As shown in FIG. 2, the refrigerator comprises a refrigerator compartment 210 and a freezer compartment 220. A refrigerator compartment evaporator 205, a refrigerator compartment fan 206, and a refrigerator compartment fan drive motor 206*a* are installed in the refrigerator compartment 210. A freezer compartment evaporator 207, a freezer compartment fan 208, and a freezer compartment fan drive motor 208*a* are installed in the freezer compartment 220. In this case, a compressor 201, a condenser 302, as shown in FIG. 3, the refrigerator compartment evaporator 205, and the freezer compartment evaporator 207 are connected to each other by refrigerant pipes to form a single refrigeration circuit.

Cool air produced from the refrigerator compartment evaporator 205 is blown into the refrigerator compartment 210 by the refrigerator compartment fan 206. Cool air produced from the freezer compartment evaporator 207 is blown into the freezer compartment 220 by the freezer compartment fan 208. A refrigerator compartment capillary tube 304, as shown in FIG. 3, and a connecting freezer compartment capillary tube 306, which are in the refrigeration circuit of the refrigerator. Further, the refrigerator compartment capillary tube 304 and the connecting freezer compartment capillary tube 306 are installed at positions around an inlet of the refrigerator compartment evaporator 205 and an inlet of the freezer compartment evaporator 207, respectively, so as to reduce a pressure level of the refrigerant.

Various refrigeration circuits of the refrigerator according to three different embodiments of the present invention and an operation and effect of the refrigeration circuits are as follows. FIG. 3 is a view showing a refrigeration circuit designed to accomplish an optimum refrigerant evaporating temperature of a refrigerator compartment evaporator 205 included in the refrigerator according to a first embodiment of the present invention. As shown in FIG. 3, to accomplish the optimum refrigerant evaporating temperature of the refrigerator compartment evaporator 205, the refrigerator compartment capillary tube 304 and the connecting freezer compartment capillary tube 306 are separately provided in the refrigeration circuit of the refrigerator. The refrigerant evaporating temperatures demanded for the refrigerator compartment evaporator 205 and the freezer compartment evaporator 207 are accomplished through the refrigerator compartment capillary tube 304 and the connecting freezer compartment capillary tube 306, respectively.

Since the connecting freezer compartment capillary tube 306 and the refrigerator compartment capillary tube 304 are connected to each other in series, a high-pressure refrigerant compressed in the compressor 201 is primarily reduced in a pressure level thereof in the refrigerator compartment capillary tube 304, and then secondarily reduced in the pressure level thereof in the connecting freezer compartment capillary tube 306. When a resistance of the refrigerator compartment s capillary tube 304 is lower than that of the connecting freezer compartment capillary tube 306, an extent of a pressure drop in the refrigerator compartment capillary tube 304 is small, so that the evaporating temperature of the refrigerant in the refrigerator compartment evaporator 205 is higher than that of the freezer compartment evaporator 207. Therefore, the optimum refrigerant evaporating temperatures demanded for the refrigerator compartment evaporator 205 and the freezer compartment evaporator 207 are accomplished, respectively.

In the refrigeration circuit of FIG. 3, a high-temperature and high-pressure refrigerant compressed in the compressor 201 transfers a heat thereof to outside air while passing the condenser 302, so the refrigerant has a low temperature and a high pressure. A condenser fan 303, and a condenser fan drive motor 303*a* are installed with the condenser 302 to transfer the heat from the high-temperature and high-pressure refrigerant to the outside air. While the high-pressure refrigerant flowing from the condenser 302 passes the refrigerator compartment capillary tube 304, the pressure level of the refrigerant is reduced, so the refrigerant readily evaporates. Thus, the refrigerant effectively evaporates in the refrigerator compartment evaporator 205 while absorbing heat of air around the refrigerator compartment evaporator 205. As such, the cool air around the refrigerator compartment evaporator 205 produced by an evaporation of the refrigerant is supplied into the refrigerator compartment 210 by the refrigerator compartment fan 206 to reduce the temperature of the refrigerator compartment 210.

After passing the refrigerator compartment evaporator 205, the refrigerant passes the connecting freezer compartment capillary tube 306. At that time, the pressure level of the refrigerant is further reduced. The refrigerant having the reduced pressure level flows into the freezer compartment evaporator 207. In such a case, the refrigerant has an evaporating temperature lower than the evaporating temperature of the refrigerator compartment evaporator 205 and effectively evaporates in the freezer compartment evaporator 207, so a temperature around the freezer compartment evaporator 207 is considerably lower than a temperature around the refrigerator compartment evaporator 205. Cool air around the freezer compartment evaporator 207 produced in this way is supplied to the freezer compartment 220 by the freezer compartment fan 208 to reduce the temperature of the freezer compartment 210.

The refrigerator compartment and connecting freezer compartment capillary tubes 304 and 306, serving as pressure reducing units, change a low-temperature and high-pressure refrigerant condensed in the condenser into a low-pressure refrigerant to allow the refrigerant to easily evaporate in the evaporators. That is, the refrigerant pressure drop performed in the refrigerator compartment and the connecting freezer compartment capillary tubes 304 and 306 is a factor in determining the refrigerant evaporating temperatures in the refrigerator compartment and freezer compartment evaporators 205 and 207. The evaporating temperature of the refrigerant in the freezer compartment 220 must be lower than that of the refrigerator compartment 210. Thus, in the refrigerator, a specification of the refrigerator compartment capillary tube 304 may be determined such that the refrigerant evaporating temperature at the refrigerator compartment evaporator 205 is 0° C. or more, thus preventing the refrigerator compartment 210 from being super cooled. Further, a specification of the connecting freezer component capillary tube 306 may be determined such that the refrigerant evaporating temperature at the freezer compartment evaporator 207 is −18° C. or less.

In the refrigerator, which is separately provided with the refrigerator compartment 210 and the freezer compartment 220, there frequently occurs a case where the temperature inside the refrigerator compartment 210 reaches a preset temperature but the temperature inside the freezer compartment 220 is higher than a preset temperature. In this case, a process of cooling only the freezer compartment 220 may be performed. In the case of cooling only the freezer compartment 220, the refrigeration circuit, formed such that the refrigerant flows into both the refrigerator compartment evaporator 205 and the freezer compartment evaporator 207, as shown in FIG. 3, makes the refrigerator compartment 210 unnecessarily cooled, thus having a low energy efficiency. Thus, when the process to cool only the freezer compartment 220 is required, the refrigeration circuit may be formed such that the refrigerant flows into only the freezer compartment evaporator 205 in response to a mode selection.

Figure 4:
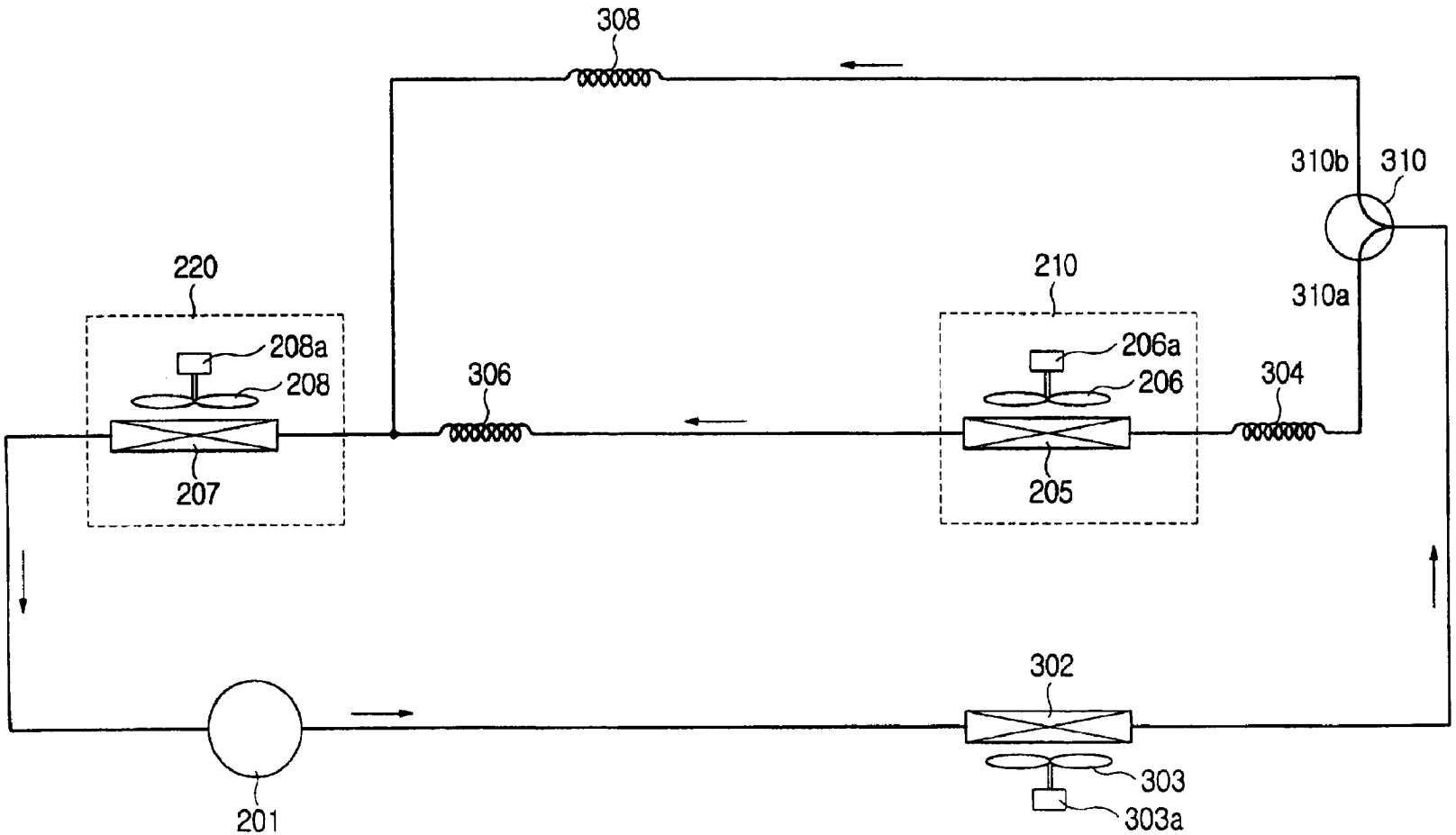
FIG. 4 is a schematic view showing a refrigeration circuit designed to be capable of cooling only a freezer compartment of the refrigerator according to the second embodiment of the present invention.

FIG. 4 is a schematic view showing a refrigeration circuit designed to be capable of cooling only the freezer compartment 220 of the refrigerator according to a second embodiment of the present invention. As shown in FIG. 4, the refrigeration circuit includes a three-way valve 310 to control a refrigerant path. The three-way valve 310 controls the refrigerant path such that a refrigerant flowing from the condenser 302 flows into one of the refrigerant compartment capillary tube 304 and freezer compartment capillary tube 308. When a first outlet 310*a* of the three-way valve 310 is closed and a second outlet 310*b* of the three-way valve 310 is open, the refrigerant passing the condenser 302 flows into only the freezer compartment evaporator 207 through the freezer compartment capillary tube 308 to cool only the freezer compartment 220. In this case, a specification of the freezer compartment capillary tube 308 is determined considering the refrigerant evaporating temperature demanded for the freezer compartment evaporator 207. That is, the freezer compartment capillary tube 308 must sufficiently reduce a pressure level of the refrigerant without the help of any other components to achieve an evaporating temperature of the refrigerant demanded for the freezer compartment evaporator 207. The refrigeration circuit allows only the freezer compartment 220 to be cooled as selected, thus preventing unnecessary cooling of the refrigerator compartment 210.

Further, in the case of cooling only the freezer compartment 220 as shown in FIG. 4, the connecting freezer component capillary tube 306 is not operated.

Alternatively, when cooling both the refrigerator compartment 210 and the freezer compartment 220 is desired, the first outlet 310*a* of the three-way valve 310 is open and the second outlet 310*b* of the three-way valve 310 is closed such that the refrigerant passing the condenser 302 flows into the refrigerator compartment 210 and the freezer compartment 220 through the refrigerator compartment capillary tube 304.

In the refrigerator, the refrigerant evaporating temperatures for the freezer compartment evaporator 207 and the refrigerator compartment evaporator 205 may be independently controlled in the refrigeration circuit shown in FIG. 3. When the connecting freezer compartment capillary tube 306 is installed between the refrigerator compartment evaporator 205 and the freezer compartment evaporator 207 such that the refrigerant in the refrigerator compartment and freezer compartment evaporators 205 and 207 have different evaporating temperatures, the connecting freezer compartment capillary tube 306 applies a load to the refrigerator compartment evaporator 205, so the refrigerant pressure drop is not sufficiently achieved in the refrigerator compartment capillary tube 304. The small pressure drop of the refrigerator compartment capillary tube 304 effectively prevents the refrigerator compartment 210 from being super cooled, but may undesirably cause a reduction in a cooling speed of the refrigerator compartment 210. When the refrigerator is restarted or a load of the refrigerator compartment 210 is sharply increased, the refrigerator compartment 210 must be rapidly cooled. However, if the refrigerant evaporating temperature at the refrigerator compartment evaporator 205 is high, the cooling speed of the refrigerator compartment 210 is reduced. Thus, the refrigeration circuit to increase the cooling speed of the refrigerator compartment 210 may be required. The refrigeration circuit will be described in the following with reference to FIG. 5.

Figure 5:
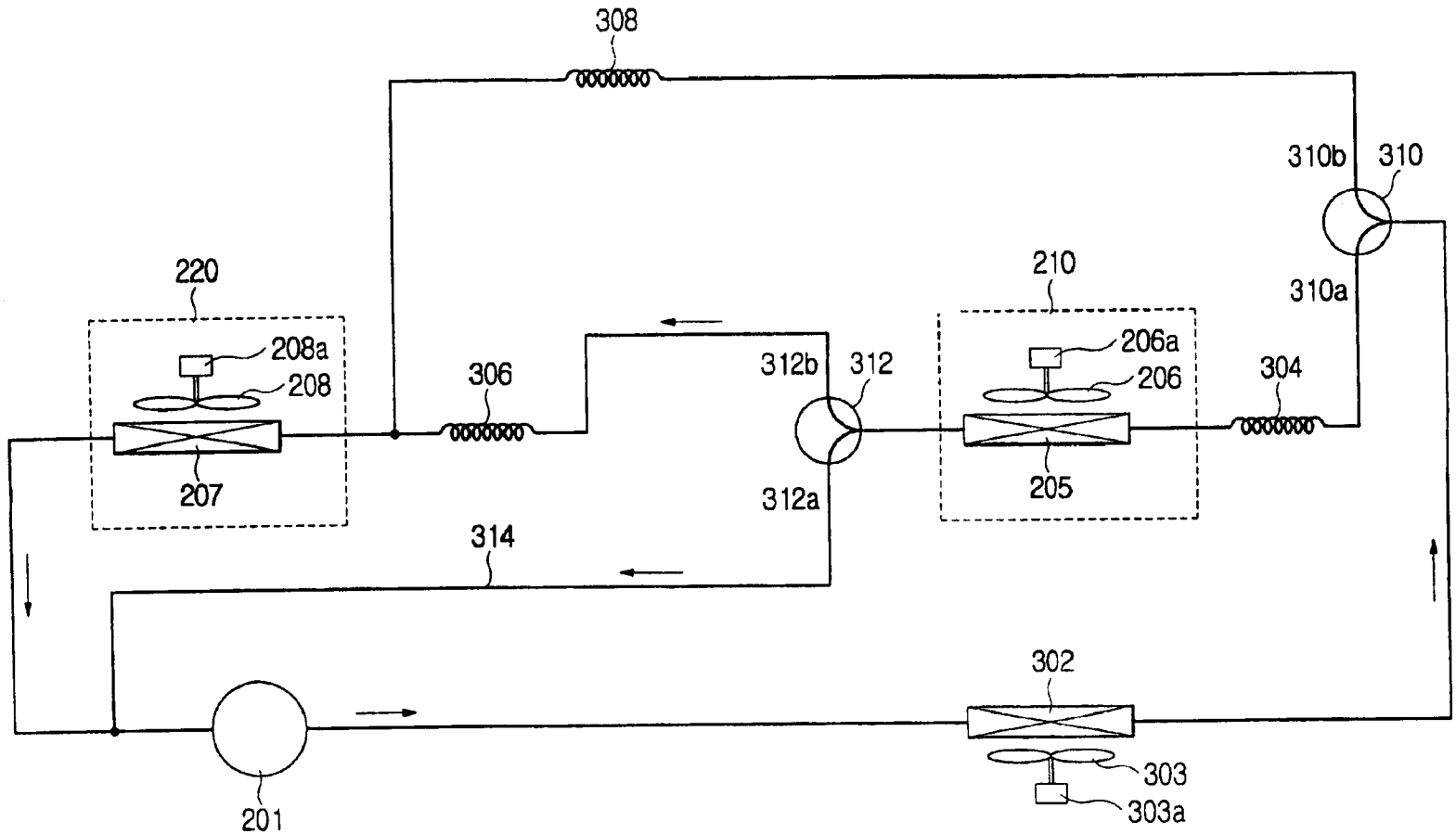
FIG. 5 is a sectional view showing a refrigeration circuit designed to increase a cooling speed of a refrigerator compartment of the refrigerator according to the third embodiment of the present invention.

FIG. 5 is a schematic view showing a refrigeration circuit designed to be capable of cooling only the refrigerator compartment 210 of the refrigerator according to a third embodiment of the present invention. The refrigeration circuit includes a second three-way valve 312 in addition to a first three-way valve 310. The second three-way valve 312 controls a refrigerant path 314 such that the refrigerant passing the refrigerator compartment evaporator 205 selectively flows into the connecting freezer compartment capillary tube 306 or the compressor 201, thus increasing the cooling speed of the refrigerator compartment 210. Thus, when only the refrigerator compartment 210 is desired to be cooled, a first outlet 312*a* of the second three-way valve 312 is open such that the refrigerant passing the refrigerator compartment evaporator 205 flows into an inlet of the compressor 201 while a first outlet 310*a* of the first three-way valve 310 is opened such that the refrigerant passing the condenser 302 flows into only the refrigerator compartment evaporator 205 through the refrigerator compartment capillary tube 304.

Since such a refrigeration circuit allows the pressure level of the refrigerant to drop in only the refrigerator compartment capillary tube 304, a large pressure drop of the refrigerant is accomplished in the refrigerator compartment capillary tube 304. In comparison with the case of cooling both the refrigerator compartment 210 and the freezer compartment 220, the refrigerant in the refrigerator compartment evaporator 205 has a relatively low evaporating temperature, thus considerably increasing the cooling speed of the refrigerator compartment 210.

As is apparent from the above description, a refrigerator is provided, which performs various refrigeration cycles by variously changing refrigerant paths thereof, thus accomplishing refrigerant evaporating temperatures suitable for a refrigerator compartment evaporator and a freezer compartment evaporator, respectively, and which cools either of a refrigerator compartment and a freezer compartment as selected, therefore enhancing cooling efficiency and increasing cooling speed.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a compressor;

a condenser;

a first evaporator;

a second evaporator, the compressor, the condenser, the first evaporator and the second evaporator being connected to each other in series to perform a refrigeration cycle;

a first expansion unit reducing a refrigerant pressure level to a first pressure level such that a refrigerant flows into the first evaporator;

a second expansion unit reducing the refrigerant pressure level to a second pressure level such that the refrigerant flows into the second evaporator first and second fans; first and second compartments to transfer heat to the first and second evaporators by the first and second fans, respectively;

a first refrigerant path provided between an outlet of the compressor and an inlet of the second evaporator;

a third expansion unit provided between an outlet of the condenser and an inlet of the second evaporator;

a first path switching unit switching a first refrigerant path such that the refrigerant, flowing from the condenser into one of the first and third expansion units, flows to a remaining one of the first and third expansion units;

a second refrigerant path provided between an outlet of the first evaporator and an inlet of the compressor; and a second path switching unit switching the second refrigerant path such that the refrigerant, flowing from the first evaporator into one of the second expansion unit and the compressor, flows to a remaining one of the second expansion unit and the compressor.

2. The refrigerator according to claim 1, wherein the second pressure level is lower than the first pressure level.

3. The refrigerator according to claim 1, wherein the first and second expansion unit each comprises a capillary tube.

4. A refrigerator, comprising;

a compressor;

a condenser;

a first evaporator;

a second evaporator, the compressor, the condenser, the first evaporator and the second evaporator being connected to each other in series to perform a refrigeration cycle, a first expansion unit reducing a refrigerant pressure level to a first pressure level such that a refrigerant flows into the first evaporator;

a second expansion unit reducing the refrigerant pressure level to a second pressure level such that the refrigerant flows into the second evaporator;

a third expansion unit provided between an outlet of the condenser and an inlet of the second evaporator; a first path switching unit switching a first refrigerant path such that the refrigerant, flowing from the condenser into one of the first and third expansion units, flows to a remaining one of the first and third expansion units; and a second path switching unit switching a second refrigerant path such that the refrigerant, flowing from the first evaporator into one of the second expansion unit and the compressor, flows to a remaining one of the second expansion unit and the compressor.

5. The refrigerator according to claim 4, wherein the second pressure level is lower than the first pressure level.

6. The refrigerator according to claim 4, wherein the first, second, and third expansion units each comprises a capillary tube.

7. The refrigerator according to claim 4, wherein the third expansion unit reduces the pressure level of the refrigerant flowing from the path switching unit to the second pressure level to make the refrigerant flow into the second evaporator.

8. A refrigerator, comprising;

a compressor;

a condenser;

a first evaporator;

a second evaporator, the compressor, the condenser, the first evaporator and the second evaporation being connected to each other in series to perform a refrigeration cycle;

a first expansion unit reducing a refrigerant pressure level to a first pressure level such that a refrigerant flows into the first evaporator;

a second expansion unit reducing the refrigerant pressure level to a second pressure level such that the refrigerant flows into the second evaporator;

a third expansion unit provided between an outlet of the condenser and an inlet of the second evaporator;

a first refrigerant path provided between an outlet of the first evaporator and an inlet of the compressor;

a first path switching unit switching the first refrigerant path such that the refrigerant, flowing from the first evaporator into one of the second expansion unit and the compressor, flows to a remaining one of the second expansion unit and the compressor; and a second path switching unit switching a second refrigerant path such that the refrigerant, flowing from the condenser into one of the first and third expansion units, flows to a remaining one of the first and third expansion units.

9. The refrigerator according to claim 8, wherein the first and second expansion unit each comprises a capillary tube.

10. A refrigerator, comprising;

a compressor;

a condenser;

a first evaporator;

a second evaporator, the compressor, the condenser, the first evaporator and the second evaporator connected to each other in series to perform a refrigeration cycle;

a first expansion unit reducing a refrigerant pressure level to a first pressure level such that a refrigerant flows into the first evaporator;

a second expansion unit reducing the refrigerant pressure level to a second pressure level such that the refrigerant flows into the second evaporator;

a third expansion unit provided between an outlet of the condenser and an inlet of the second evaporator;

a first refrigerant path provided between an outlet of the compressor and an inlet of the second evaporator; and a first path switching unit switching the first refrigerant path such that the refrigerant, flowing from the condenser into one of the first and third expansion units, flows to a remaining one of the first and third expansion units;

a second refrigerant path provided between an outlet of the first evaporator and an inlet of the compressor; and a second path switching unit switching the second refrigerant path such that the refrigerant, flowing from the first evaporator into one of the second expansion unit and the compressor, flows to a remaining one of the second expansion unit and the compressor.

11. The refrigerator according to claim 10, wherein the third expansion unit reduces the pressure level of the refrigerant flowing from the first path switching unit to the second pressure level to make the refrigerant flow into the second evaporator.

12. The refrigerator according to claim 10, wherein the first, second and third expansion units each comprise a capillary tube.

13. A refrigerator having first and second compartments and one or more refrigerant paths including a compressor, a condenser, and first and second evaporators, operatively connected in series, comprising;

first and second fans to transfer heat to the first and second evaporators from the first and second compartments, respectively;

a first expansion unit provided in a refrigerant path before the first evaporator to reduce a refrigerant pressure level to a first pressure level such that a refrigerant with the first pressure level flows into the first evaporator; a second expansion unit provided in the refrigerant path before the second evaporator to reduce a refrigerant pressure level to a second pressure level such that the refrigerant with the second pressure level flows into the second evaporator;

a third expansion unit provided between an outlet of the condenser and an inlet of the second evaporator;

a first reconfiguration unit to reconfigure the refrigerant path such that the refrigerant, flowing from the condenser into one of the first and third expansion units, flows to a remaining one of the first and third expansion units; and a second reconfiguration unit to reconfigure the refrigerant path such the refrigerant, flowing from the first evaporator into one of the second expansion unit and the compressor, flows to a remaining one of the second expansion unit and the compressor.

14. The refrigerator according to claim 13, wherein the second pressure level is lower than the first pressure level.

15. The refrigerator according to claim 13, wherein the first and second expansion units each comprises a capillary tube.

16. The refrigerator according to claim 13, wherein:

when the refrigerant flowing from the condenser flows into the first expansion unit, the first compartment is cooled; and when the refrigerant flowing from the condenser flows into the third expansion unit, the second compartment is cooled.

17. The refrigerator according to claim 13, wherein the first reconfiguration unit is a three-way valve.

18. The refrigerator according to claim 13, wherein the second pressure level is lower than the first pressure level.

19. The refrigerator according to claim 13, wherein the first, second, and third expansion units each comprises a capillary tube.

20. The refrigerator according to claim 13, wherein the third expansion unit reduces the pressure level of the refrigerant flowing from the first reconfiguration unit to the second pressure level such that with the second pressure level flows into the second evaporator.

21. The refrigerator according to claim 13, wherein:

when the refrigerant flowing from the first evaporator flows into the compressor only the first compartment is cooled; and when the refrigerant flowing from the first evaporator flows into the second expansion unit both the first and second compartments are cooled.

22. The refrigerator according to claim 13, wherein the second reconfiguration unit is a three-way valve.

23. The refrigerator according to claim 13, wherein the first and second expansion unit each comprises a capillary tube.

24. The refrigerator according to claim 13, wherein:

when the refrigerant flowing from the condenser flows into the third expansion unit, only the second compartment is cooled;

when the refrigerant flowing from the condenser flows into the first expansion unit and the refrigerant flowing from the first evaporator flows into the second expansion unit, both the first and second compartments are cooled; and when the refrigerant flowing from the condenser flows into the first expansion unit and the refrigerant flowing from the first evaporator flows into the compressor, only the first compartment is cooled.

25. The refrigerator according to claim 13, wherein the first, second, and third expansion units each comprises a capillary tube.

26. The refrigerator according to claim 13, wherein the third expansion unit reduces the pressure level of the refrigerant flowing from the first reconfiguration unit to the second pressure level such that with the second pressure level flows into the second evaporator.

27. The refrigerator according to claim 14, wherein the second pressure level is lower than the first pressure level so that an evaporating temperature of the refrigerant in the first evaporator is higher than an evaporating temperature of the refrigerant in the second evaporator.

28. A refrigerator having first and second compartments and including a compressor, a condenser, and first and second evaporators, operatively connected, comprising;

a first expansion unit provided in a refrigerant path before the first evaporator to reduce a refrigerant pressure level in the first evaporator;

a second expansion unit provided in the refrigerant path before the second evaporator to reduce a refrigerant pressure level in the second evaporator;

a third expansion unit provided between an outlet of the condenser and an inlet of the second evaporator; and a reconfiguration unit to reconfigure the refrigerant path among the compressor, the condenser, and the first and second evaporators such that when the refrigerant flowing from the condenser flows into the third expansion unit, only the second compartment is cooled, when the refrigerant flowing from the condenser flows into the first expansion unit and the refrigerant flowing from the first evaporator flows into the second expansion unit, both the first and second compartments are cooled, and when the refrigerant flowing from the condenser flows into the first expansion unit and the refrigerant flowing from the first evaporator flows into the compressor, only the first compartment is cooled.

* * * * *